US007070465B2

(12) United States Patent
Masaki et al.

(10) Patent No.: US 7,070,465 B2
(45) Date of Patent: Jul. 4, 2006

(54) SOCKET CONTACT

(75) Inventors: Katsuyuki Masaki, Kanagawa (JP); Shinichi Kodama, Kanagawa (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/261,715

(22) Filed: Oct. 31, 2005

(65) Prior Publication Data

US 2006/0094305 A1 May 4, 2006

(30) Foreign Application Priority Data

Nov. 1, 2004 (JP) ..... 2004-317950

(51) Int. Cl.
*H01R 11/22* (2006.01)

(52) U.S. Cl. ..... 439/850

(58) Field of Classification Search ..... 439/850, 439/857, 843, 845

See application file for complete search history.

(56) References Cited

U.S. PATENT DOCUMENTS 4,553,808 A * 11/1985 Weidler et al. ..... 439/391
4,693,536 A * 9/1987 Colleran et al. ..... 439/404
4,943,248 A * 7/1990 Colleran et al. ..... 439/850
5,399,098 A * 3/1995 Marshall et al. ..... 439/398
5,980,336 A * 11/1999 Hall et al. ..... 439/843

FOREIGN PATENT DOCUMENTS

| | | | |
|---|---|---|---|
| JP | H09-24513 | A | 9/1997 |
| JP | 2001-085088 | A | 3/2001 |
| JP | 2001-527687 | A | 12/2001 |
| JP | 2002-033150 | A | 1/2002 |
| WO | WO-98/02942 | A | 1/1998 |

* cited by examiner

*Primary Examiner*—Phuong Dinh
(74) *Attorney, Agent, or Firm*—Rader, Fishman & Grauer PLLC

(57) ABSTRACT

A socket contact which is connected to an opposing planar contact, comprises: a long connection part to which a lead wire is connected; and a contact connection part which is connected to the opposing contact provided on the base-end side of the connection part. The contact connection part comprises a planar contact body, a pair of extended arms which are almost parallel and extends from the base-end side of the contact body, and a pair of reversed arms which are almost parallel and extends from the tips of the pair of extended arms to the contact body, the tips of which are mutually joined. The pair of reversed arms are provided with a pair of contact points which are mutually opposed and into which opposing contacts can be inserted.

4 Claims, 6 Drawing Sheets

SOCKET CONTACT

FIELD OF THE INVENTION

Priority is claimed on Japanese Patent Application No. 2004-317950, filed Nov. 1, 2004, the content of which is incorporated herein by reference.

The present invention relates to a socket contact and, more particularly, to a socket contact which is a pair of elastic contact pieces that extend in parallel and apply contact force to both surfaces of an opposing, planar or straight-fluted contact.

RELATED ART

Batteries are embedded into modern, miniaturized mobile electronic devices such as, for example, DSC (Digital Still Camera), mobile telephones, CD players, MD players and the like. In order to feed power supply from this battery to a circuit substrate (printed circuit board) provided within the electronic device, an infinitesimal, so-called chip-sized package-type, wire-to-board connector is used.

As the foregoing connector and socket connector, a connector has been invented which eliminates a problem of being easily broken, due to entanglement between both connectors caused by difference in the insertion/removal directions and the direction in which the lead wire is extended, if the socket connector is attached to the end of a lead wire extending from the battery, the base connector is fixed to the printed circuit board, and the lead wire is pulled when removing the socket connector from the base connector (for example, refer to Patent Reference 1).

In the connector according to Patent Reference 1, when the lead wire is pulled, this pulling force is converted into a force that follows in the direction the socket connector is pulled and removed, by the actions of the cam surfaces of the base connector and the socket connector. In addition, in this connector, a socket contact for applying contact force such that the opposing planar contact is embraced from both sides by a pair of contact pieces is used in the socket connector.

[Patent Reference 1] Japanese Patent Laid-Open Publication No. 2002-33150

FIG. 10 is a longitudinal sectional view of both connectors in a coupled state, according to Patent Reference 1. In FIG. 10, hatchings on sections of the socket connector and flat connection terminal are omitted. Additionally, FIG. 10 in the present application corresponds to FIG. 9 in Patent Reference 1. In FIG. 10, connector 100 comprises a base connector 6 and socket connector 7. Base connector 6 is soldered and bonded onto the mounting surface of a printed circuit board, which is not illustrated. On the other hand, socket connector 7 is coupled with base connector 6 and inserted into/removed from a concave part (inserting/removing space) formed in base connector 6.

In FIG. 10, the housing 60 of base connector 6 is provided with a flat connection terminal 8. On the other hand, the housing 70 of socket connector 7 is provided with a socket contact 9. For example, tripolar flat connection terminals 8 are aligned in parallel within housing 60, and the corresponding three socket contacts 9 are aligned in parallel within housing 70. Lead wire 9*w*, which is crimped to crimp part 92 of socket contact 9, extends from housing 70.

In FIG. 10, in flat connection terminal 8, main body 80 is pressed and fixed to housing 60, and contact part 81 protrudes into the concave part formed in base connector 6. On the other hand, socket contact 9 is inserted into a square-columnar reception chamber 71 and is held therein. In reception chamber 71, the region corresponding to contact part 91 of socket contact 9 is opened towards the concave part.

In FIG. 10, socket connector 7 is inserted into the concave part formed in base connector 6 and fitted into base connector 6. Furthermore, a pair of flat connection terminals 8 and socket connector 9 are connected to allow electrical conduction.

FIG. 11 is a front view of the socket contact in Patent Reference 1. Additionally, FIG. 11 of the present application corresponds to FIG. 8 in Patent Reference 1. In FIG. 11, socket contact 9 comprises a pair of contact pieces 91*a* and 91*b*, which oppose each other and extend in parallel, and contact points 91*c* and 91*d*, which are protrusions protruding towards each other, are provided on the opposing surfaces of the pair of contact pieces 91*a* and 91*b*.

In FIG. 11, contact part 81 (see FIG. 10) of flat connection terminal 8 in base connector 6 is led into gap S, between the pair of contact points 91*c* and 91*d*, such that flat connection terminal 8 is elastically retained in an embraced-state by the pair of contact pieces 91*a* and 91*b*, designed to secure contact force between flat connection terminal 8 and socket contact 9.

Although socket contact 9 shown in FIG. 11 can handle, for example, rated voltage 50V and rated current "1" A (ampere), there are requests for rated current of 2 A. However, if a current of 2 A is allowed to flow into connector 100, the connector, for example, generates heat exceeding the regulated temperature of 30° C., which is not practical. Although this foregoing request can be resolved to some extent by changing the socket contact to a material with low resistance, the request may be resolved by, for example, changing the shape, such as by increasing the contact force of the socket contact.

On the other hand, there are requests for further lowering of the mounting height of socket connector 7, shown in FIG. 10. However, the mounting height of socket connector 7 is basically regulated by the extension length of the pair of contact pieces 91*a* and 91*b*, provided in socket contact 9. It is difficult to realize a socket connector with a further lowered height in a conventional socket contact. A socket contact with a structure enabling improvement of contact force with the flat connection terminal and further lowering of the height of the socket connector is desired.

In order to resolve the foregoing issue, application of a so-called tuning fork-type contact, an elastic contact with a tuning fork-shape which is a flat terminal and applies contact force in the direction of opposing plate thickness by two arms, to the socket contact is considered.

However, in order to secure contact force with the flat connection terminal, the pair of arms in the tuning fork-type contact must be widened. This is because elasticity can be enhanced by increasing the sectional secondary moment of the fixed ends of each arm.

On the other hand, since, in the bipolar flat connection terminal 8 shown in FIG. 10, the required inter-polar pitch is, for example, 1.2 mm, the terminals cannot be aligned in parallel in socket connector 7, in the widened tuning fork-type contact. In other words, in the tuning fork-type contact, it is difficult to realize a socket connector suitable for high-density mounting, even if contact force can be secured. A socket contact suitable for high-density mounting and lowered height is required to replace the tuning fork-type contact.

In addition, there is concern that residual stress, accompanying the crimping process performed on an open crimp barrel when a so-called bellows-type two-way contact and the tuning fork-type contact shown FIG. 10 and FIG. 11 are both crimp contacts to which the lead wire is crimped, may affect the pair of contact pieces (arms), the tips of which are opened.

For example, there is concern that the distance between the pair of contact points may vary with long-term deterioration. The contact points may be deformed in a widening direction because the tips of the pair of contact pieces (arms) are opened. A socket contact is required, which eliminates such anxiety and is more reliable. Furthermore, a socket contact with a structure, wherein the shape is not damaged during transfer in each process until the product is completed, is required. These are the issues of the present invention.

SUMMARY OF THE INVENTION

In view of the foregoing issues, the object of the present invention is to provide a socket contact which holds both surfaces of a planar contact with a pair of elastic contacts, having a structure which is low-height, miniaturized and suitable for high-density mounting and having a structure which can secure contact force with the planar contact.

In order to achieve the foregoing object, the inventors have invented a new socket contact such as that below, providing a pair of extended arms and a pair of reversed arms, whose longitudinal shape is U-shaped by folding back and reversing a piece of the socket contact, mutually joining the tips of this pair of reversed arms, also providing a pair of contact points on the folded-back side of the reversed arms, and designing the pair of contact points such as to apply contact force to both surfaces of the opposing contact.

(1) A socket contact which is connected to an opposing planar contact, wherein the socket contact comprises a long connection part to which a lead wire is connected and a contact connection part which is connected to the opposing contact provided on the base-end side of the connection part, the contact connection part comprises a planar contact body, a pair of extended arms which are almost parallel and extends from the base-end side of the contact body, and a pair of reversed arms which are almost parallel and extends from the tips of the pair of extended arms to the contact body, the tips of which are mutually joined, and the pair of reversed arms are provided with a pair of contact points which are mutually opposed and into which opposing contacts can be inserted.

The socket contact according to (1) is a socket contact which is connected to an opposing planar contact, comprising a long connection part to which a lead wire is connected and a contact connection part which is connected to the opposing contact provided on the base-end side of the connection part. In addition, the contact connection part comprises a planar contact body, a pair of extended arms which are almost parallel and extends from the base-end side of the contact body, and a pair of reversed arms which extends from the tips of the pair of extended arms to the contact body, the tips of which are mutually joined.

Here, for example, the longitudinal sections of the pair of extended arms and the pair of reversed arms can be shapes forming a U-shape or J-shape. In addition, the shape can be such that the arms are branched into two from the base-end side of the contact body, each extended arm is extended in the longitudinal direction, and furthermore, after each extended arm is bent at an almost right angle and erected, they are bent at an almost right angle again, such that each reversed arm returns to the direction heading towards the base-end side. Thus, each extended arm and each reversed arm are continuous, and the pair of extended arms and the pair of reversed arms can indicate mutually parallel regions.

In addition, the pair of extended arms, the thick-plate surfaces of which are mutually opposed, maintain an almost parallel shape and remain as such from the pair of folded-back parts further up to the pair of reversed arms. In other words, the thick-plate surfaces of the pair of folded-back parts and the pair of reversed arms are mutually opposed. It can be also said that the pair of extended arms, the pair of folded-back parts and the pair of reversed arms are separated.

Furthermore, the tips of the pair of reversed arms are mutually joined. What "the tips of the pair of reversed arms are mutually joined" includes is, for example, when the tips of the pair of reversed arms are mutually joined in advance and the pair of reversed arms is formed by a folding processing, and also when the tips of the pair of reversed arms are mutually joined by welding or the like, after the pair of reversed arms are formed by the folding processing.

In addition, in the socket contact according to (1), the pair of reversed arms is provided with a pair of contact points that are mutually opposed and into which the opposing contacts can be inserted. The pair of reversed arms is provided with a pair of mutually opposing contact points on the thick-plate surfaces of the folded-back part sides, and the opposing planar contacts can be inserted between the pair of contact points. For example, the opposing contact can be inserted between the pair of contact points from the folded-back part side to the tips of the pair of reversed arms, and preferably, the opposing contact is inserted between the pair of contact points from the pair of reversed arms to the pair of extended arms.

If the opposing contact is inserted between the pair of contact points, the pair of contact points are pressed and widened. In other words, the folded-back part sides of the pair of extended arms and the pair of reversed arms are pressed and widened. Because the folded-back part side of the pair of extended arms and the pair of reversed arms and the opposite side are mutually joined, contact force can be applied to both surfaces of the opposing contact by elastic force.

The socket contact according to the present invention can apply a stronger contact force to the opposing contact than a conventional socket contact, and furthermore, can be more miniaturized than the conventional socket contact. This is because the socket contact according to the present invention is structured such that the conventional tuning fork-type contact has two stages. In addition, the socket contact according to the present invention can be aligned in parallel, even in narrow pitch.

In the socket contact according to the present invention, the long connection part can be a crimp part wherein the lead wire is crimped, a pressure-welding part wherein the lead wire is pressure-welded, or inserted into a through-hole of a printed circuit board, becoming a pin terminal that is "solder" bonded. The connection part of the socket contact according to the present invention can be formed in adherence to the application.

When the socket contact according to the present invention is a crimp contact wherein the lead wire is crimped, because the tips of the pair of reversed arms are mutually joined, the conventional issue regarding concern over deformation in the widening direction of the pair of contact pieces, the tops of which are opened, is considered eliminated. The bent opened-ends of the pair of contact pieces and the two-stage structure are also considered to contribute to the elimination of the foregoing issue.

(2) The socket contact according to (1), wherein the tips of the pair of reversed arms are connected arcuately.

Stress is thought to be dispersed in the arcuate connection part, lowering stress concentration, by forming the tips of the pair of reversed arms into a smooth shape wherein they are connected to each other arcuately, when the opposing contact is inserted into the pair of reversed arms. Generation of deformation is thought to be suppressed by allowing the tips of the pair of reversed arms to be an arcuate connection part.

In addition, preferably, the stress is considered to be further dispersed ideally by gradually decreasing the respective widths of the pair of reversed arms towards the pair of contact points, subsequent to the arcuate connection part.

(3) The socket contact according to (1) or (2), wherein the contact body comprises a pair of folded pieces that extend towards the pair of reversed arms provided at both edges, and the tips of the pair of folded pieces are in contact with the tip-sides of the pair of reversed arms.

For example, the connector with crimp contact is manufactured into a finished product through various processes. For example, there is a process for manufacturing the crimp contact, a process for crimping the lead wire to the crimp contact, a process for mounting the crimp contact with the lead wire onto a connector, and the like. In each process, the socket contact may be transferred within one plant or the socket contact may be transferred between pluralities of separate plants. And, damage to the shape of the socket contact by, for example, dropping the socket contact during transfer can be considered.

In the socket contact according to (1), the shape is considered to be not damaged by the foregoing accident because the pair of folded pieces is in contact with the tip-sides of the pair of reversed arms such that the tip-sides of the pair of reversed arms are not deformed to the pair of extended arms-side.

(4) The socket contact according to any one of (1) to (3), wherein the connection part crimps the lead wire.

Generally, crimping the lead wire means to bend a part of a component of a crimp terminal to envelope and fix the core material, such as lead wire, and to electrically (or mechanically) connect the lead wire and contact by fixing as such. The connection part which becomes the crimp part can be provided with a so-called conductor grip which crimps the lead wire. In addition, a so-called insulation grip, which bends the part of a component of the crimp terminal to envelope the lead wire over its coating material and mechanically fixes the lead wire, can be provided.

The socket contact according to (4) is a socket contact suitable for an infinitesimal, so-called chip-sized package-type, wire-to-board connector. The body of the socket contact according to the present invention can be provided with a so-called lance, a lanciform protrusion for enabling the socket contact to engage with the connector housing.

(5) A socket connector comprising the socket contact according to (4).

Because the contact connection part connected to the opposing contact is provided with a pair of extended arms and a pair of reversed arms, whose longitudinal shape is U-shaped by folding back and reversing the base-end side of the contact body, wherein the tips of this pair of reversed arms are joined, and also provided with a pair of contact points on the reversed arms, wherein the pair of contact points are designed such as to apply contact force to both surfaces of the opposing contact, the socket contact according to the present invention can apply a contact force which is stronger than that of conventional socket contact to the opposing contact and can made smaller than the conventional socket contact, as well. The socket contact according to the present invention can be aligned in parallel, even in narrow pitch.

Furthermore, stress is thought to be dispersed in the arcuate connection part, lowering stress concentration, and generation of deformation is thought to be suppressed, by forming the tips of the pair of reversed arms into a smooth shape wherein they are connected arcuately, when the opposing contact is inserted into the pair of reversed arms.

DESCRIPTION OF THE PREFERRED EMBODIMENT

The preferred embodiment of the present invention is described below, with reference to the drawings.

Figure 1:
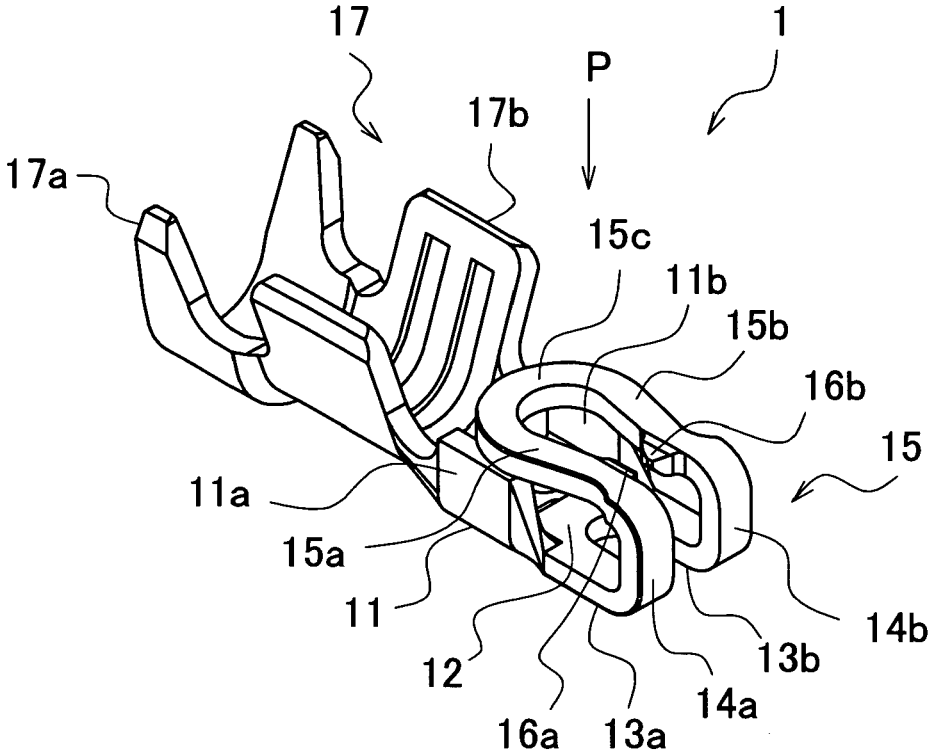
FIG. 1 is a perspective outline view showing one embodiment of a socket contact according to the present invention.
Figure 2:
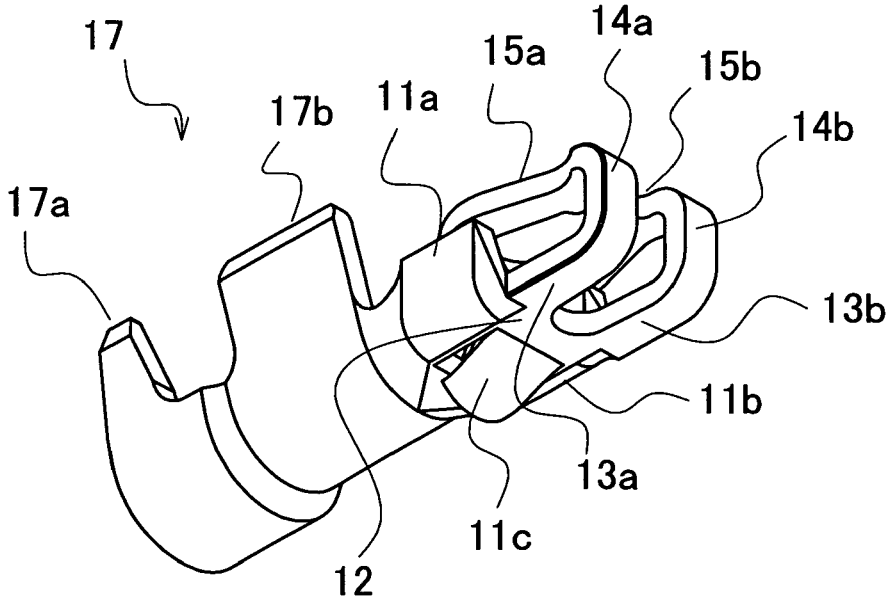
FIG. 2 is a perspective outline view of the socket contact according to the embodiment.
Figure 3:
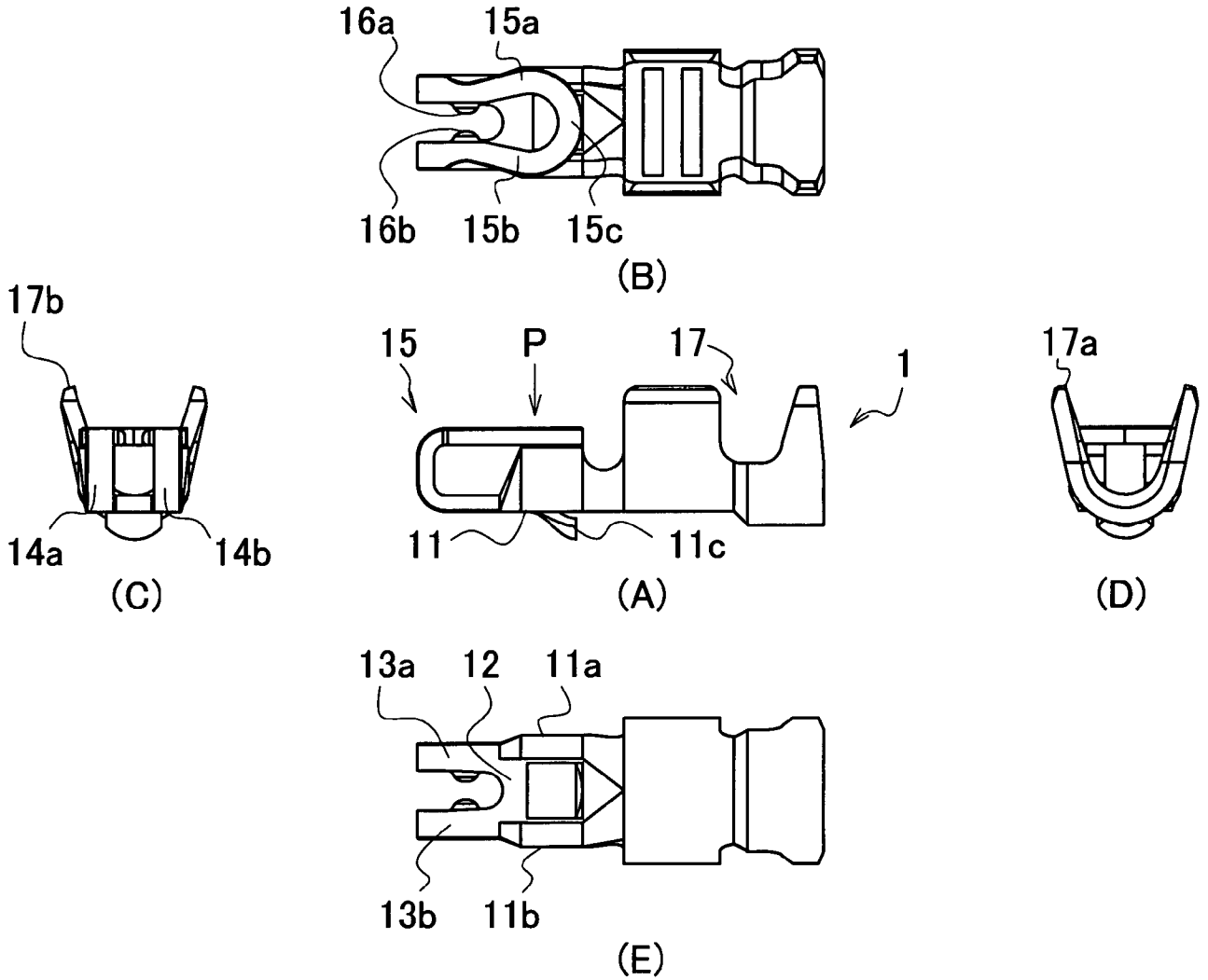
FIG. 3 is an outline view of the socket contact according to the embodiment.

FIG. 1 is a perspective outline view showing one embodiment of a socket contact according to the present invention. FIG. 2 is a perspective outline view of the socket contact according to this embodiment. FIG. 2 shows the socket contact from the side opposite of that in FIG. 1. FIG. 3 is an outline view of the socket contact according to the embodiment. FIG. 3(A) is a front view, FIG. 3 (B) is a top view, FIG. 3(C) is a left-side view, FIG. 3(D) is a right-side view and FIG. 3(E) is a bottom view.

Figure 4:
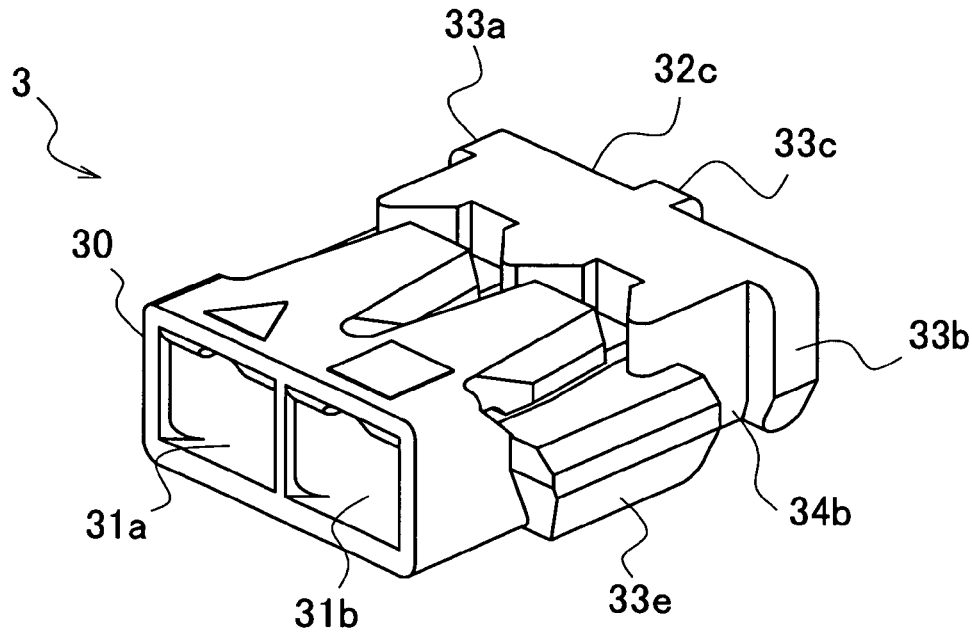
FIG. 4 is a perspective outline view of a socket connector to which the socket contact according to the embodiment is applied.
Figure 5:
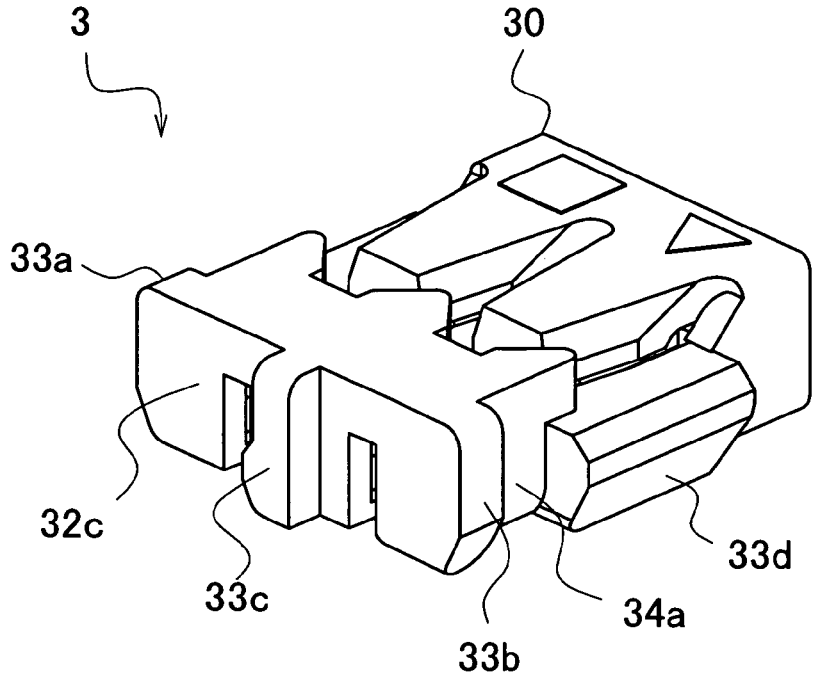
FIG. 5 is a perspective outline view of the socket connector to which the socket contact according to the embodiment is applied.
Figure 6:
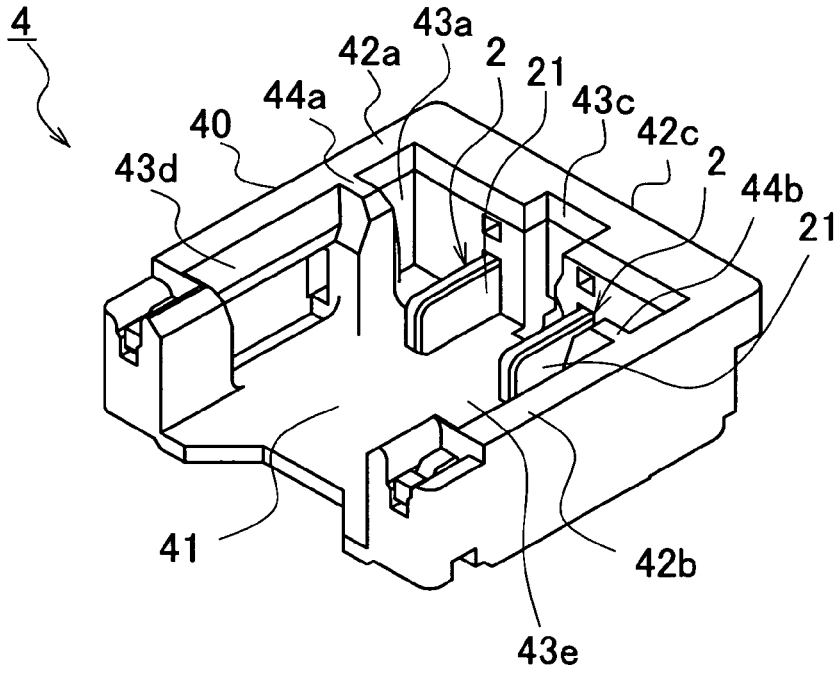
FIG. 6 is a perspective outline view of a base connector which is coupled with the socket connector according to the embodiment.
Figure 7:
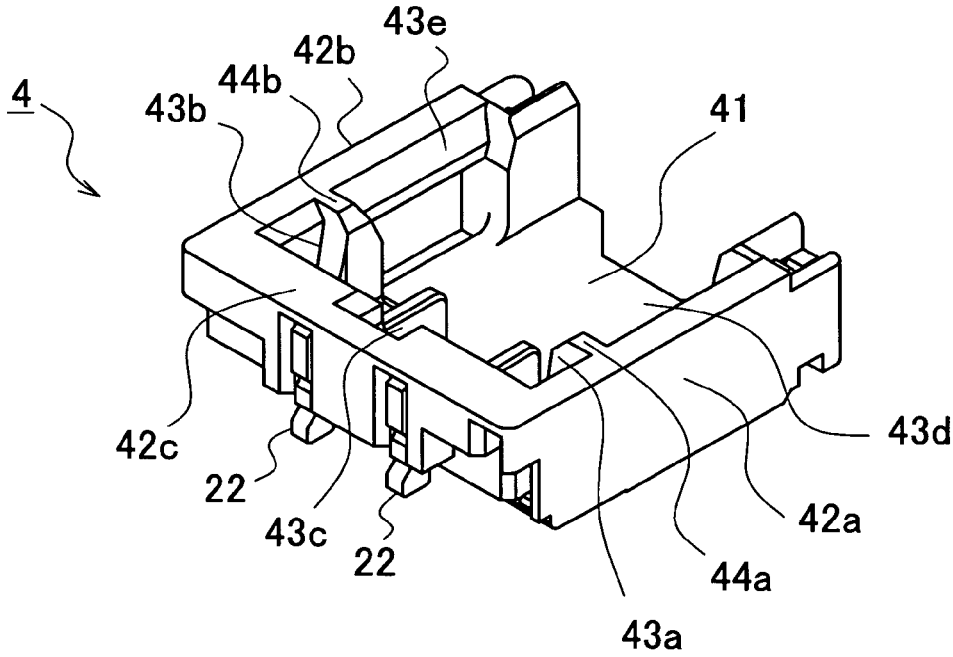
FIG. 7 is a perspective outline view of the base connector which is coupled with the socket connector according to the embodiment.

FIG. 4 is a perspective outline view of a socket connector to which the socket contact according to the embodiment is applied. FIG. 5 is a perspective outline view of the socket connector to which the socket contact according to the embodiment is applied. FIG. 5 shows the socket connector from the side opposite of that in FIG. 4. FIG. 6 is a perspective outline view of a base connector which is coupled with the socket connector according to the embodiment. FIG. 7 is a perspective outline view of the base connector which is coupled with the socket connector according to the embodiment. FIG. 7 shows the base connector from the side opposite of that in FIG. 6.

Figure 8:
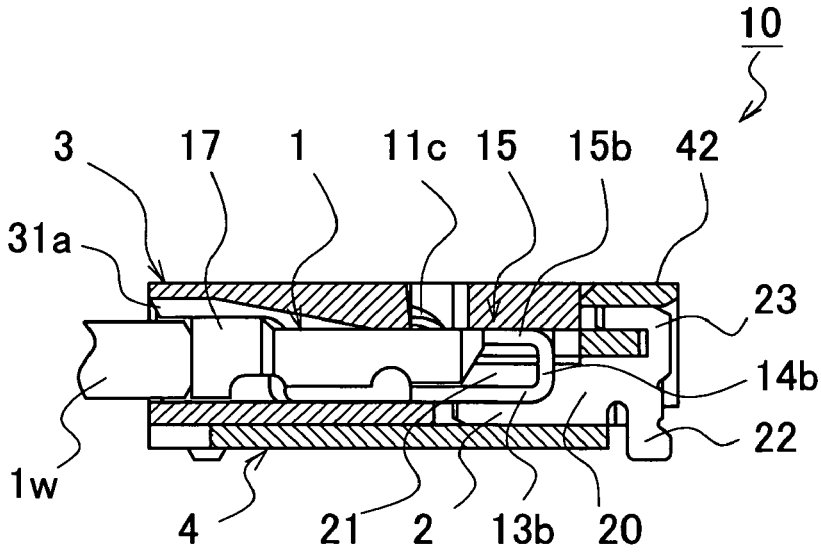
FIG. 8 is a longitudinal sectional view of both connectors in a coupled state according to the embodiment.
Figure 9:
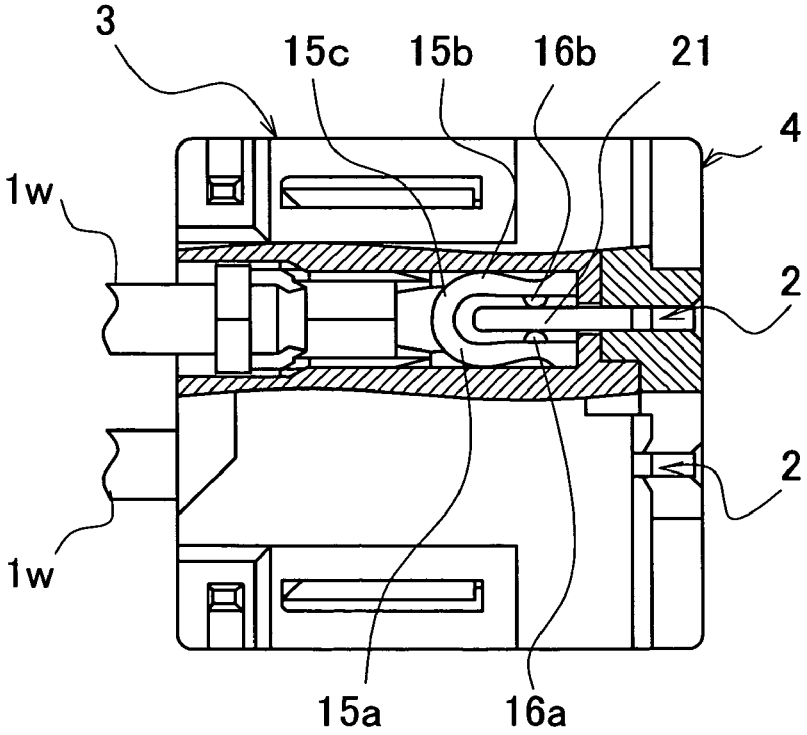
FIG. 9 is a top view of both connectors in a coupled state according to the embodiment, the principal section thereof being a cross sectional view.
Figure 10:
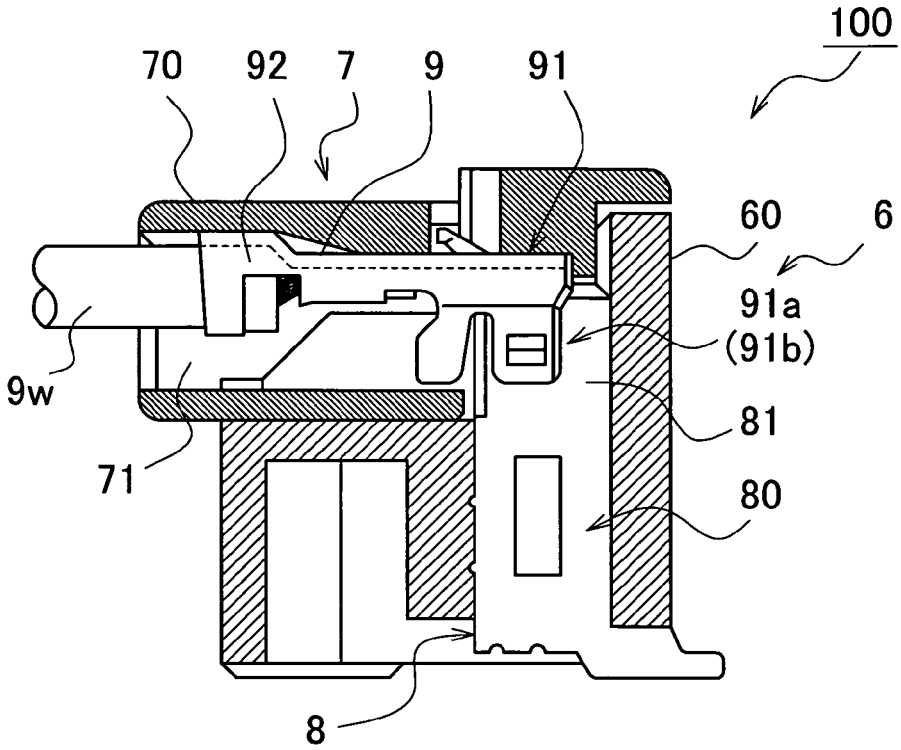
FIG. 10 is a longitudinal sectional view of both connectors in a coupled state according to prior art.
Figure 11:
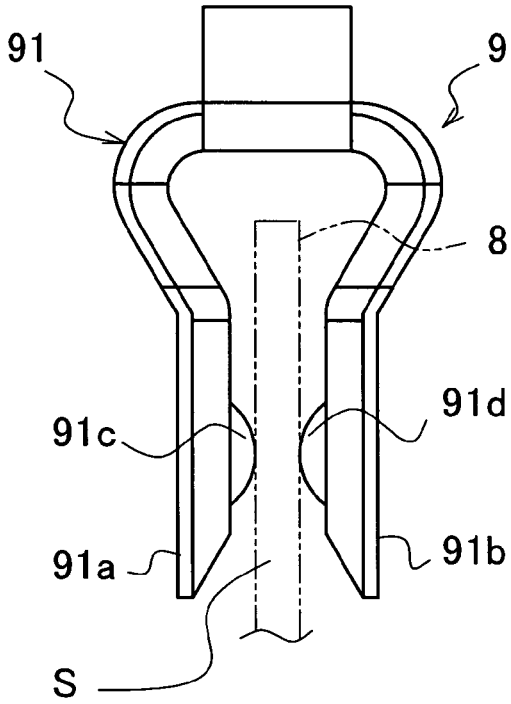
FIG. 11 is a top view of a socket contact according to prior art.

FIG. 8 is a longitudinal sectional view of both connectors in a coupled state according to the embodiment. FIG. 9 is a top view of both connectors in a coupled state according to the embodiment. FIG. 9 shows a cross sectional view of the principal sections.

First, the socket contact according to the present invention is described. In FIG. 1 and FIG. 2, the socket contact 1 is provided with a long connection part 17 to which the lead wire 1*w* is connected and a contact connection part 15 which is connected to an opposing contact 2 provided at the base-end side of the connection part 17. The contact connection part 15 is provided with a planar contact body 11, a pair of extended arms 13*a* and 13*b* which are almost in parallel and extends from the base-end 12 side of the contact body 11, and a pair of reversed arms 15*a* and 15*b* which are almost in parallel and extends from the tips of the pair of extended arms towards the contact body 11, the tips of which are coupled.

As shown FIG. 1 or FIG. 2, the contact body 11 is branched into two from the base-end 12 side and extends the pair of extended arms 13*a* and 13*b*, the thick-plate surfaces of which are mutually opposed, almost in parallel in a longitudinal direction. In addition, the pair of extended arms 13*a* and 13*b* is folded-back and reversed in the longitudinal direction and the pair of reversed arms 15*a* and 15*b*, which oppose in parallel with the pair of extended arms 13*a* and 13*b*, is provided.

In addition, as shown in FIG. 3, the socket contact 1 is formed such that it is branched into two from the base-end 12 side, each extended arm, 13*a* and 13*b*, extends in a longitudinal direction, and furthermore, after each extended arm, 13*a* and 13*b*, is bent at an almost right angle and erected, they are again bent at an almost right angle, and each reversed arm, 15*a* and 15*b*, returns to the direction heading towards the contact body 11. As shown in FIG. 1 to FIG. 3, each extended arm, 13*a* and 13*b* and each reversed arm, 15*a* and 15*b* are connected, respectively. In FIG. 1 to FIG. 3, the pair of extended arms 13*a* and 13*b* and the pair of reversed arms 15*a* and 15*b* indicate mutually parallel regions.

In addition, the pair of extended arms 13*a* and 13*b*, the thick-plate surfaces of which are mutually opposed, maintain an almost parallel shape and remain as such from the pair of folded-back parts 14*a* and 14*b* further up to the pair of reversed arms 15*a* and 15*b*. In other words, the thick-plate surfaces of the pair of folded-back parts 14*a* and 14*b* and the pair of reversed arms 15*a* and 15*b* are mutually opposed. The pair of extended arms 13*a* and 13*b*, the pair of folded-back parts 14*a* and 14*b* and the pair of reversed arms 15*a* and 15*b* are separated from each other.

As shown in FIG. 1 to FIG. 3, the tips of the pair of reversed arms 15*a* and 15*b* are mutually joined. The tips of the pair of reversed arms 15*a* and 15*b* are mutually joined in advance and the pair of reversed arms 15*a* and 15*b* is formed by a folding processing.

As shown in FIG. 1 to FIG. 3, the pair of reversed arms 15*a* and 15*b* is provided with a pair of contact points 16*a* and 16*b* formed from mutually opposing semispherical protrusions on the thick-plate surfaces of the folded-back part 14*a* and 14*b* sides. An opposing planar contact 2 (see FIG. 6) can be inserted between this pair of contact points 16*a* and 16*b*.

In FIG. 1 or FIG. 3, for example, the opposing contact 2 can be inserted between the pair of contact points 16*a* and 16*b* from the pair of folded-back part 14*a* and 14*b* sides to the tips of the pair of reversed arms 15*a* and 15*b*, and it is preferable that the opposing contact 2 is inserted between, the pair of contact points 16*a* and 16*b* from the pair of reversed arms 15*a* and 15*b* to the pair of extended arms 13*a* and 13*b*.

If the opposing contact 2 is inserted between the pair of contact points 16*a* and 16*b*, the pair of contact points 16*a* and 16*b* are pressed and widened. Namely, the folded-back part 14*a* and 14*b* sides of the pair of extended arms 13*a* and 13*b* and the pair of reversed arms 15*a* and 15*b* are pressed and widened. Because the folded-back part 14*a* and 14*b* sides and the opposing sides of the pair of extended arms 13*a* and 13*b* and the pair of reversed arms 15*a* and 15*b* are mutually joined, contact force can be applied to both surfaces of the opposing contact 2 by elastic force.

The socket contact according to the present invention can apply a stronger contact force than that of a conventional socket contact to the opposing contact, and furthermore, can be made smaller than a conventional socket contact. This is because the socket contact according to the present invention has a structure such as that wherein the conventional tuning fork-type contact is doubled. It can be said that a pair of contact pieces has been made into to a dual-structure of each extended arm and each reversed arm. In addition, the socket contact according to the present invention can be aligned in parallel, even in narrow pitch, as described hereafter.

In the socket contact 1, the connection part 17 can be, as described hereafter, a crimp part wherein the lead wire is crimped, a pressure-welding part wherein the lead wire is pressure-welded, or inserted into a through-hole of a printed circuit board, becoming a pin terminal that is "solder" bonded. The connection part 17 of the socket contact 1 can be formed in adherence to the application.

When the socket contact according to the present invention is a crimp contact wherein the lead wire is crimped, because the tips of the pair of reversed arms are mutually joined, the conventional issue regarding concern over deformation in the widening direction of the pair of contact pieces, the tops of which are opened, is considered eliminated. The bent opened-ends of the pair of contact pieces and the two-stage structure are also considered to contribute to the elimination of the foregoing issue.

As shown FIG. 1 or FIG. 3, the tips of the pair of reversed arms 15*a* and 15*b* are connected to each other, arcuately. In addition, subsequent to the arcuate connection part 15*c*, respective widths of the pair of reversed arms 15*a* and 15*b* are gradually decreased towards the pair of contact points 16*a* and 16*b*. The contours of the pair of reversed arms 15*a* and 15*b*, including the arcuate connection part 15*c*, are formed into a horseshoe-shape.

Stress is thought to be dispersed in the arcuate connection part 15*c*, lowering stress concentration, by forming the tips of the pair of reversed arms 15*a* and 15*b* into a smooth shape, wherein they are connected to each other arcuately, when the opposing contact 2 is inserted. Generation of deformation is thought to be suppressed by allowing the tips of the pair of reversed arms 15*a* and 15*b* to be the arcuate connection part 15*c*.

In addition, preferably, the stress is considered to be further dispersed ideally by gradually decreasing the respective widths of the pair of reversed arms towards the pair of contact points, subsequent to the arcuate connection part.

As shown in FIG. 1 to FIG. 3, the planar contact body 11 is comprises a pair of folded pieces 11*a* and 11*b* that extend towards the pair of reversed arms 15*a* and 15*b*, provided on both edges of the base-end 12 side. In addition, the tips of the pair of folded pieces 11*a* and 11*b* are in contact with the tip-sides of the pair of reversed arms 15*a* and 15*b*.

By thus providing the pair of folded pieces 11*a* and 11*b* as such, deformation of the tip-sides of the pair of reversed arms 15*a* and 15*b* towards the pair of extended arms 13*a* and 13*b* side can be prevented, with regards to force P applied to the pair of reversed arms 15*a* and 15*b* (see FIG. 1 or FIG. 3).

In FIG. 1 to FIG. 3, the contact connection part 15 includes the pair of extended arms 13*a* and 13*b* and the pair of reversed arms 15*a* and 15*b*. In addition, the contact connection part 15 includes the pair of folded-back parts 14*a* and 14*b*, the connection part 15*c* and the pair of contact points 16*a* and 16*b*.

On the other hand, the connection part 17 is a crimp part wherein the lead wire 1*w* is crimped (hereinafter, the connection part 17 is referred to as the crimp part 17). As shown in FIG. 1 to FIG. 3, the crimp part 17, connected to the contact body 11, is provided with an insulation grip 17*a* and a conductor grip 17*b* that are the open crimp barrels.

Generally, crimping the lead wire means to bend a part of a component of a crimp terminal to envelope the core material, such as lead wire, and fix the core material, and the conductor grip 17*b*, wherein the lead wire 1*w* and the socket contact 1 are electrically (or mechanically) connected, is provided. In addition, the insulation grip 17*a*, which bends the part of a component of the crimp terminal to envelope the lead wire over its coating material and mechanically fixes the lead wire and the socket contact 1, is provided.

The socket contact 1 shown in FIG. 1 to FIG. 3 is a socket contact suitable for an infinitesimal, so-called chip-sized package-type, wire-to-board connector. In addition, the contact body 11 of the socket contact 1 is provided with a so-called lance 11*c* (refer to FIG. 2 and FIG. 3), a lanciform protrusion for enabling the socket contact 1 to engage with the housing 30, described hereafter.

Next, the socket connector to which the socket contact according to the present invention is applied, the base connector which is coupled with the socket connector, and both connectors in a coupled-state are described.

As shown in FIG. 8, the connector 10 comprises a base connector 4 that is "solder" bonded to the mounting surface of a printed circuit board, not illustrated, and a socket connector 3 which is assembled with the base connector 4 and is inserted into/removed from a concave part 41 (refer to FIG. 6) of the base connector 4. The connector 10 is used, for example, to connect the printed circuit board and battery provided in DSC.

In FIG. 6, the concave part 41 of the base connector 4 is positioned in a direction that intersects with the mounting surface of the printed circuit board, not illustrated, and is opened in a direction facing away from the mounting surface. In addition, the concave part 41 of the base connector 4 in one direction out of the directions in parallel with the mounting surface is opened. The socket connector 3 is inserted into and removed from the concave part 41 of the base connector 4 along the insertion and removal directions intersecting with the mounting surface. The socket connector 3 is provided with the lead wire 1*w*which almost extends forward (refer to FIG. 8).

In FIG. 6, the base connector 4 comprises housing 40, and the housing 40 is provided with an erected back wall 42*c* and a pair of left and right side walls 42*a* and 42*b*. The concave part 41 into which the socket connector 3 is inserted and from which the socket connector 3 is removed is divided by this pair of side walls 42*a* and 42*b* and the back wall 42*c*.

In FIG. 6 and FIG. 7, two planar contacts (flat connection terminal) 2, in parallel with the pair of side walls 42*a* and 42*b*, are accommodated within the concave part 41. In FIG. 8, two contacts 2 are held by the housing 40, inserted through the corresponding fixed holes formed in the back wall 42*c* of the housing 40.

The contact 2 comprises a body 20 that is a rough rectangle and a lead section 22 which extends backward from the lower end of the body 20. The body 20 has a contact part 21 that protrudes towards the concave part 41 and the press-fitting protrusion 23 that is pressed into the back wall 42*c*. As shown in FIG. 6 and FIG. 7, chamfering is formed on the upper edge and front edge of the contact part 21 to facilitate the insertion of the socket contact 1, corresponding to the socket connector 3. Each contacts 2 is connected by being sandwiched from both sides, by the pair of reversed arms 15*a* and 15*b*formed in the socket contact 1, corresponding to the socket connector 3, both connectors 3 and 4 in a coupled-state (refer to FIG. 9).

In FIG. 6 and FIG. 7, the back wall 42*c* is provided with a longitudinal groove 42*c*. When both connectors 3 and 4 are coupled, a longitudinal rib 33*c* (refer to FIG. 5) formed at one end-face in the housing 30 of the socket connector 3 is fitted into a longitudinal groove 43*c*.

In FIG. 6 and FIG. 7, a, pair of engagement grooves 43*a* and 43*b* which each extend upward and downward is provided on the inner surfaces of the pair of side walls 42*a* and 42*b*. The pair of longitudinal ribs 33*a* and 33*b* (refer to FIG. 4 and FIG. 5) formed in both wings of the housing 30 of the socket connector 3 are designed to engage with the pair of engagement grooves 43*a* and 43*b*.

In FIG. 6 and FIG. 7, a pair of engagement grooves 43*d* and 43*e* is provided on the side opposite of the back wall 42*c*. When both connectors 3 and 4 are coupled, a pair of engagement pieces 33*d* and 33*e*, formed to protrude from the other end-face in the housing 30 of the socket connector 3 (refer to FIG. 4 and FIG. 5), is engaged with the pair of engagement grooves 43*d* and 43*e*.

In FIG. 6 and FIG. 7, the engagement groove 43*a* and engagement groove 43*d* are divided by the longitudinal rib 44*b* (refer to FIG. 6). On the other hand, the engagement groove 43*b* and engagement groove 43*e* are divided by the longitudinal rib 44*b* (refer to FIG. 7). The pair of longitudinal ribs 44*a* and 44*b* is inserted into and removed from the concave part 41 by being guided by a pair of guiding grooves 34*a* and 34*b* formed in both wings of the housing 30 of the socket connector 3.

In FIG. 4 to FIG. 7, the longitudinal rib 33*c* and the longitudinal 43*c*, and the pair of engagement pieces 33*d* and 33*e* and the pair of engagement grooves 43*d* and 43*e* configure a locking mechanism for maintaining a state wherein the socket connector 3 is engaged with the base connector 4.

In FIG. 4, the housing 30 of the socket connector 3 is provided with a pair of square-columnar reception chambers 31*a*, 31*b*, the ends of which are opened. The socket contact 1 with lead wire 1*w* is inserted into the pair of reception chambers 31*a* and 31*b* and held (refer to FIG. 8).

In FIG. 8, the lance 11*c* is communicated with the pair of reception chambers 31*a* and 31*b* and is engaged with the engagement hole opened on the exterior of the housing 30. In FIG. 8, the socket contact 1 does not separate from the housing 30 even if the lead wire 1*w* is pulled.

In FIG. 8 and FIG. 9, the region within the pair of reception chambers 31*a*and 31*b* corresponding to the contact connection part 15 in the socket contact 1 is opened towards the concave part 41. In FIG. 8 and FIG. 9, the opposing contact 2 is inserted between the pair of contact points 16*a* and 16*b* from the pair of reversed arms 15*a* and 15*b* to the pair of extended arms 13*a* and 13*b* and the socket connector 3 is engaged with the base connector 4. In addition, the pair of opposing contacts 2 is connected to the pair of socket contacts 1 to allow electrical conduction.

The socket connector 3 shown in FIG. 4 and FIG. 5 is significantly miniaturized, from the viewpoint of the structure of the socket contact 1. In addition, the inter-polar pitch of the opposing contact 2 shown in FIG. 6 is, for example, 1.2 mm, and the socket connector 3 can handle this, from the viewpoint of the structure of the socket contact 1. In addition, the connector 10 enables high-density mounting to the printed circuit board.

What is claimed is:

1. A socket contact which is connected to an opposing planar contact, comprising:

a long connection part to which a lead wire is connected; and a contact connection part which is connected to the opposing contact provided on the base-end side of the connection part, wherein the contact connection part comprises a planar contact body, a pair of extended arms which are almost parallel and extends from the base-end side of the contact body, and a pair of reversed arms which are almost parallel and extends from the tips of the pair of extended arms to the contact body, the tips of which are mutually joined; and the pair of reversed arms are provided with a pair of contact points which are mutually opposed and into which opposing contacts can be inserted, wherein said contact body comprises a pair of folded pieces provided on both side edges and extending towards said pair of reversed arms; and the tips of the pair of folded pieces are in contact with the tip-sides of the pair of reserved arms.

2. The socket contact according to claim 1, wherein the tips of said pair of reversed arms are coupled arcuately.

3. The socket contact according to claim 1, wherein said connection part crimps the lead wire.

4. A socket connector comprising the socket contact according to claim 3.

* * * * *